United States Patent [19]

Lombardi

[11] 3,961,589

[45] June 8, 1976

[54] BUOYANT CABLE ANTENNA REELING SYSTEM

[75] Inventor: Anthony Joseph Lombardi, Flanders, N.J.

[73] Assignee: International Telephone and Telegraph Corporation, Nutley, N.J.

[22] Filed: July 11, 1975

[21] Appl. No.: 596,037

[52] U.S. Cl. ..... 114/16 R; 9/8 R; 114/235 B ; 242/54 A; 343/709; 343/877

[51] Int. Cl.[2] ..... B63G 8/42

[58] Field of Search ..... 114/235 R, 235 B, 16 R; 9/8 R; 244/1 TD; 242/54 A; 340/3 T; 343/709, 877

[56] References Cited

UNITED STATES PATENTS

| | | | |
|---|---|---|---|
| 2,272,213 | 2/1942 | Lear | 242/54 A |
| 3,412,704 | 11/1968 | Buller et al. | 340/3 T |
| 3,541,989 | 11/1970 | Leonard | 114/16 |
| 3,600,898 | 8/1971 | Godfrey et al. | 114/16 R X |

*Primary Examiner*—Trygve M. Blix
*Assistant Examiner*—Sherman D. Basinger
*Attorney, Agent, or Firm*—John T. O'Halloran; Menotti J. Lombardi, Jr.; Alfred C. Hill

[57] ABSTRACT

The reeling system is contained within a buoy towed by a submerged submarine. The reeling system includes a pressure sealed housing, a cable reel disposed for rotation within the housing and a buoyant cable antenna disposed in an ejecting and retracting relationship with the reel. One end of the cable antenna extends from the housing to the exterior of the buoy. A cylinder-piston arrangement having a sea water inlet and a connection to the housing is responsive to the pressure of the sea water at the inlet to control air pressure in the housing to provide a pressure difference between the air pressure in the housing and the pressure of the sea water on the one end of the cable antenna exterior of the buoy for ejection and retraction of the cable antenna from and into the buoy.

14 Claims, 5 Drawing Figures

BUOYANT CABLE ANTENNA REELING SYSTEM

BACKGROUND OF THE INVENTION

This invention relates to an arrangement to permit VLF (very low frequency) communications with a submerged submarine and more particularly to a buoyant cable antenna arrangement for such communications.

In recent years there have been two major systems which permit VLF communications with a submerged submarine. One such system includes a buoyant hydrodynamic shaped buoy towed by a submerged submarine. In this system VLF reception is achieved through the combination of a crossed loop antenna located in the nose section of the buoy and an electro-mechanical tow cable linking the buoy with the submarine. The radio signals are received by the crossed loop antenna and then travel through the tow cable to the receiving equipment in the submarine.

The second system employs a floating cable antenna that is unreeled from a submerged submarine, floats to the surface and receives the radio signals which travel through the length of the floating cable into the submarine.

Although both of the above-mentioned systems have functioned satisfactorily they are however limited in certain areas. For example, in the floating cable antenna system there is a limit of submarine keel depth and maximum speeds at which the floating cable antenna system is operational. The buoy system on the other hand is operational at a greater submarine keel depth when traveling at the same maximum speeds. If, however, the depth of the submarine is decreased, the speed of the buoy system can be increased which is an important factor when considering strategic maneuverability. VLF reception is better in the floating cable antenna system due to the fact that the cable floats on the water surface whereas in the buoy system the buoy is towed below the surface of the water where reception can be erratic depending on sea state conditions and buoy stability.

Although there are other shortcomings and advantages of both the above-mentioned systems, it can be seen from the above that each system has its advantages.

SUMMARY OF THE INVENTION

An object of the present invention is to provide an improved system for VLF communications with a submerged submarine.

Another object of the present invention is the provision of an improved VLF communications system for a submerged submarine combining the good features of each of the above-mentioned prior art systems which results in a more effective and reliable communications system.

Still another object of the present invention is to provide a buoyant cable antenna reeling system contained within a buoy towed by a submerged submarine that is capable of releasing or ejecting and retracting a buoyant cable antenna from and into the buoy under control of the pressure of sea water.

A feature of the present invention is the provision of a buoyant cable antenna reeling system for a buoy towed by a submerged submarine comprising: a pressure sealed housing contained within the buoy; a cable reel disposed for rotation within the housing; a buoyant cable antenna disposed in an ejection and retracting relationship with the reel, the cable antenna having one end thereof extending from the housing to the exterior of the buoy; and a cylinder-piston arrangement having a sea water inlet and a connection to the housing, the arrangement being responsive to the pressure of the sea water at the inlet to control air pressure in the housing to provide a pressure difference between the air pressure in the housing and the pressure of the sea water on the one end of the cable antenna exterior of the buoy for ejection and retraction of the cable antenna from and into the buoy.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
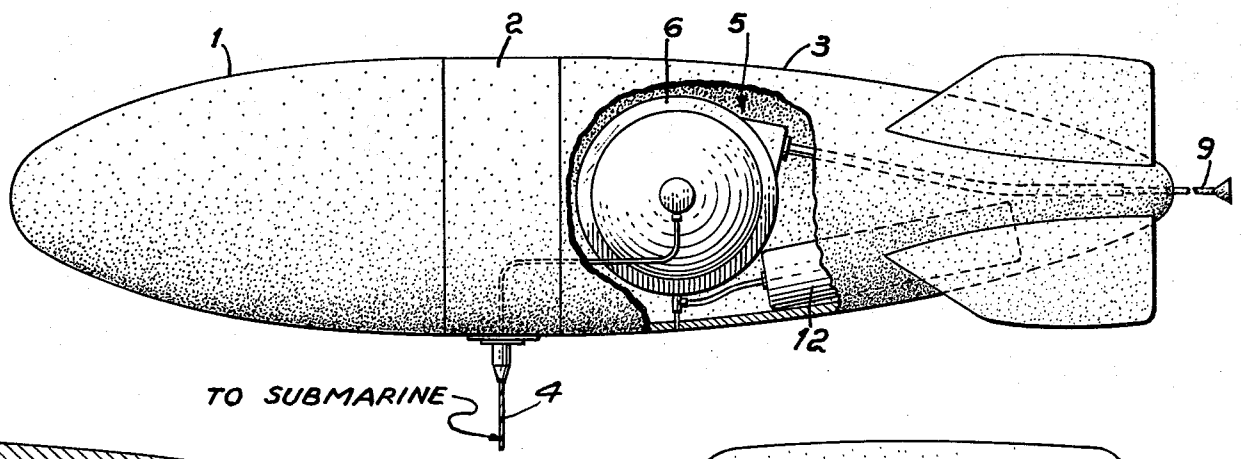
FIG. 1 is a side view of a buoy towed by a submerged submarine with a portion of the skin removed illustrating generally the buoyant cable antenna reeling system in accordance with the principles of the present invention.

Referring to FIG. 1, there is illustrated therein a hydrodynamic shaped buoy including a nose section 1, a center section 2, a tail section 3 and an electro-mechanical tow cable 4, which connects the buoy to a submerged vessel. Tail section 3 contains the buoyant cable antenna reeling system 5 and the buoyant cable antenna 9. As illustrated in FIG. 1, the electrical part of the electro-mechanical cable 4 is connected to the reeling system 5 to permit VLF signals received by buoyant cable antenna 9 to be coupled to the submerged submarine.

Figure 2:
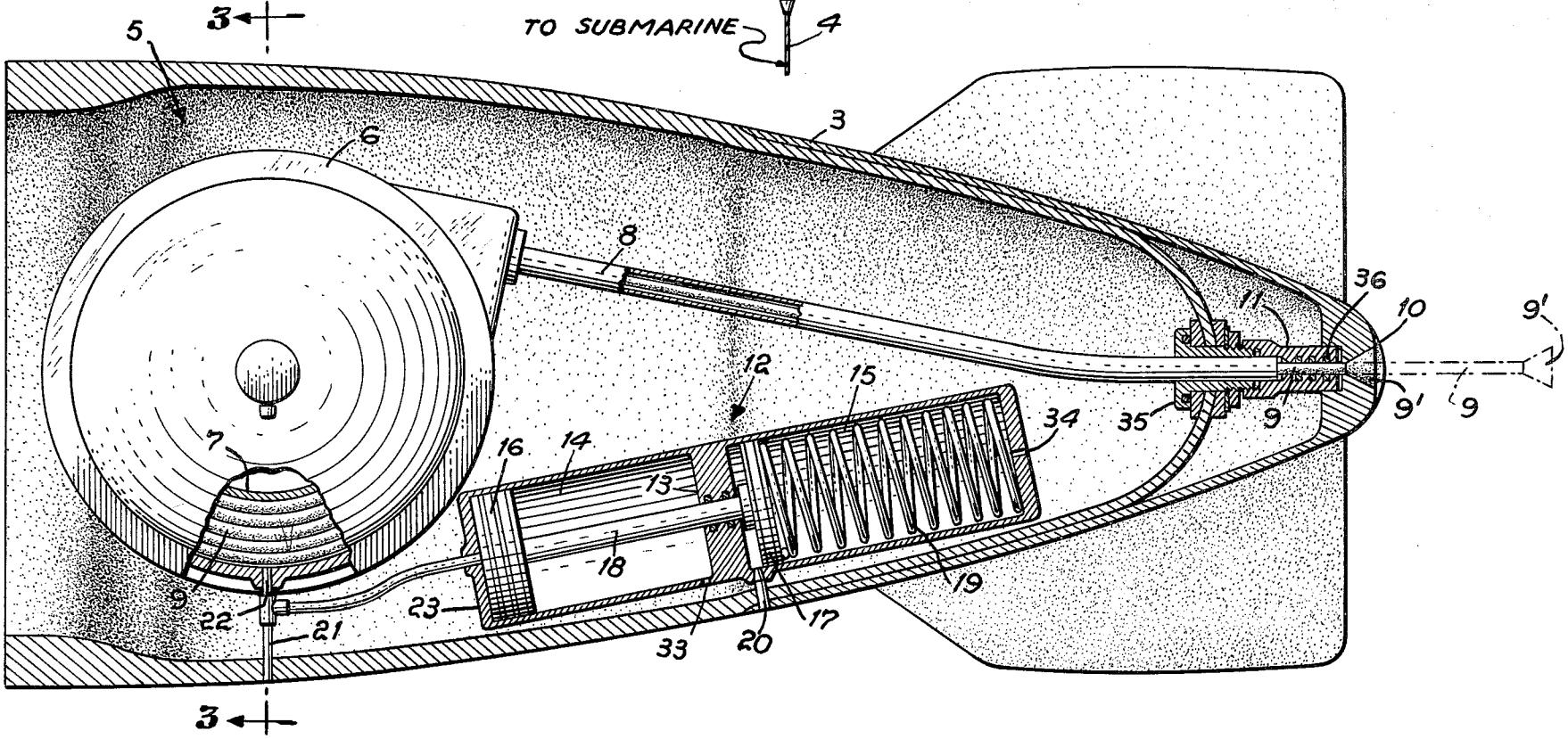
FIG. 2 is a cross-sectional view of the tail section of the buoy of FIG. 1 illustrating in greater detail the buoyant cable antenna reeling system in accordance with the principles of the present invention.
Figure 3:
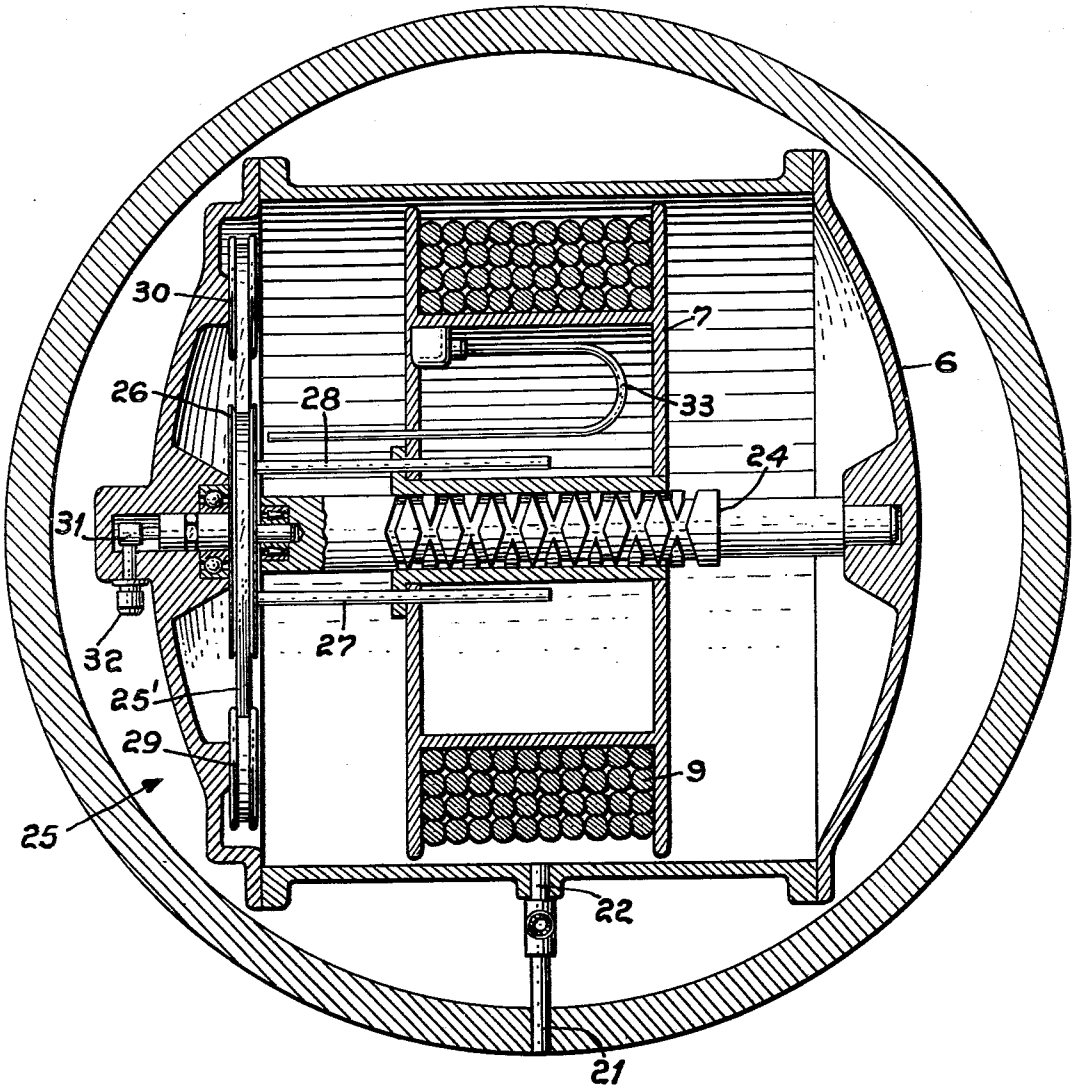
FIG. 3 is a cross-sectional view taken along line 3—3 of FIG. 2 illustrating in greater detail the components of the buoyant cable antenna reeling system in accordance with the principles of the present invention.
Figure 5:
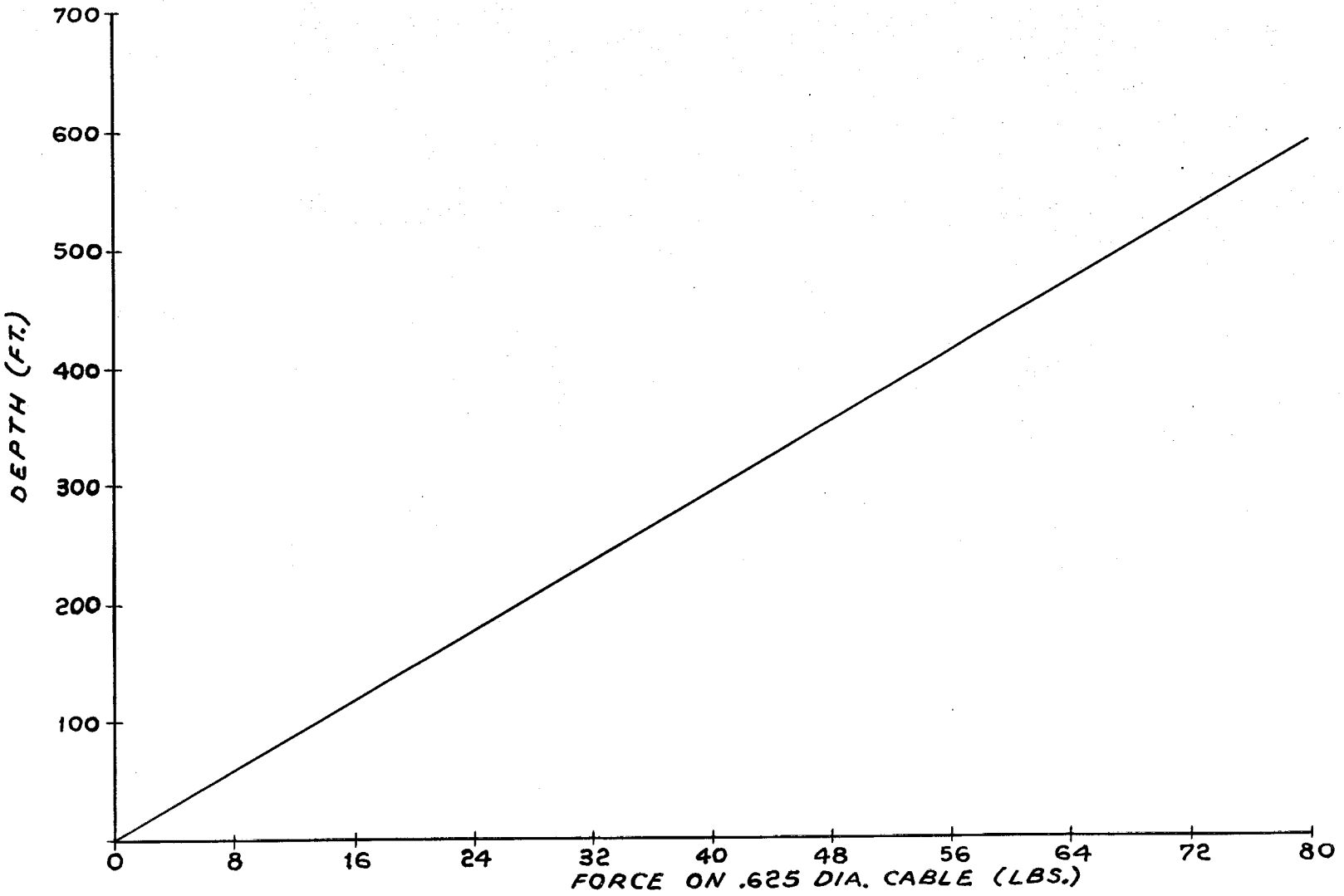
FIG. 5 is a graph illustrating the forces that are developed on the end of a 0.625 diameter buoyant cable antenna at various sea depths.

Referring to FIGS. 2 and 3, there is illustrated in greater detail the buoyant antenna reeling system 5 contained in tail section 3 of the buoy. The reeling system 5 includes a buoyant cable antenna reel housing 6 which is pressure sealed, a buoyant cable antenna reel 7, the buoyant cable antenna 9, cable guide 8 extending from housing 6 to an opening 10 through which cable antenna 9 extends for exposure to the pressure of the sea water and through which cable antenna 9 is ejected and retracted. The end of cable antenna 9 exposed to the sea water pressure is enlarged at 9' to prevent cable antenna 9 from being completely retracted through opening 10. A pressure gland 11 is provided to seal opening 10 and yet enable cable antenna 9 to be ejected and retracted therethrough. There is further provided in the reeling system a pressure cylinder actuator 12 having a partition 13 disposed transverse of the longitudinal axis of cylinder 12 to form a first chamber 14 adjacent housing 6 and a second chamber 15 remote from housing 6. A piston 16 is disposed in chamber 14 and a piston 17 is disposed in chamber 15. A connecting member 18 extending through partition 13 in a sealed relation connects pistons 16 and 17 into an integral movable unit. A spring 19 biases piston 17 toward housing 6. A sea water inlet 20 disposed between partition 13 and piston 17 enables piston 17 to respond to the pressure of the sea water entering through inlet 20. A sea water outlet 21 and a connection 22 to housing 6 is disposed between piston 16 and an end wall 23 of cylinder 12.

Figure 4:
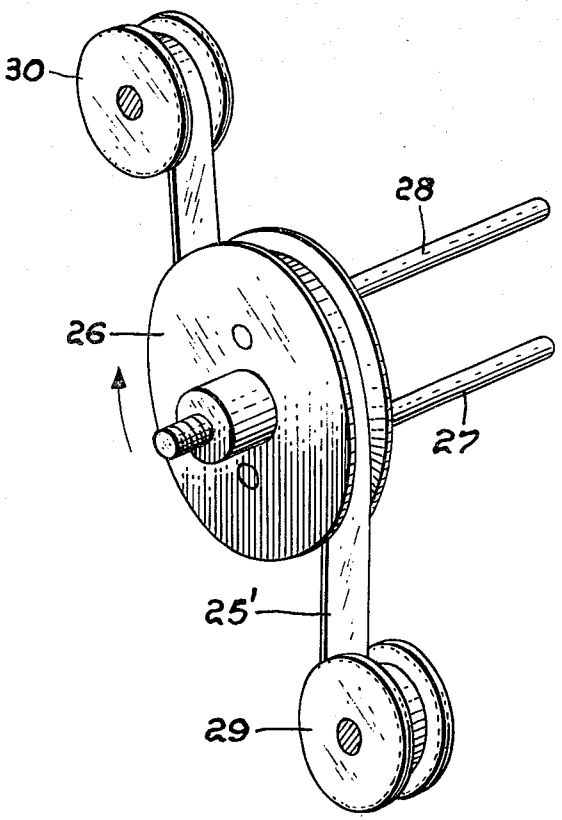
FIG. 4 is a perspective view of the take-up spring assembly of FIG. 3.

In addition to the foregoing components the reeling system of the present invention includes a righthand /lefthand lead screw 24 and take-up spring assembly 25 shown in greater detail in FIG. 4. Assembly 25 includes a spring 25', a spring drive pulley 26, drive rods 27 and 28 and spring idler pullies 29 and 30. In addition, a slip ring 31 and an RF (radio frequency) connector 32 and a flexible RF cable 33 are provided to transmit the radio signal received by cable antenna 9 to the electromechanical tow cable 4 for transmission of the received radio signal to the submerged submarine.

The following sequence of operation is presented to clearly outline the operation of the buoyant cable antenna reeling system of the present invention. The reeling system is housed within the tail section 3 of a buoy that is either housed on or towed by a submarine and is cycled through the phases normally encountered during submarine operation, such as surfaced, submerged, surfaced.

Under a first condition, the assumption is made that the submarine is operating at snorkel depth, and that the buoy is housed on the submarine. Sea water will enter pressure port 20, but since the sea pressure against piston 17 at this depth is not sufficient to overcome the force of spring 19, the reeling system will remain as shown in FIG. 2.

In a second condition, it is assumed that the submarine is submerging to its operational depth and the buoy is still housed on the submarine. As the submarine depth increases, the sea pressure acting through port 20 and on piston 17 will increase causing piston 17 to move and compress spring 19. When piston 17 moves away from housing 6 piston 16 also moves away from housing 6 due to connecting member 18. This action causes the air pressure in housing 6 to become negative, that is, less than atmospheric. The reeling system stays in this position until the buoy is released from its cradle on the submarine.

A third condition assumes that the submarine is submerged to its operational depth, the tethered buoy is released from its submarine cradle and is ascending to its required reception depth. During the ascending phase, the sea pressure acting on piston 17 is gradually decreasing allowing spring 19 to overcome the sea pressure on piston 17, thereby moving pistons 17 and 16 toward housing 6. The motion of piston 17 expels sea water through port 20 and at the same time piston 16 pumps a volume of air into housing 6. This action causes a build-up of air pressure in housing 6, creating a pressure differential between that portion of the buoyant cable antenna which is still within housing 6 and that end of buoyant cable antenna 9 which is exposed to sea pressure. Since the air pressure within housing 6 is greater than the sea pressure on the end of buoyant cable antenna 9, cable antenna 9 will be ejected out of tail section 3 until the pressure differential ceases to exist or until the full amount of buoyant cable antenna 9 is ejected.

It should be noted that the volume of chamber 14 has to be greater than the volume of housing 6 under all conditions so that a slight motion of pistons 16 and 17 will create a pressure differential which provides the necessary pressure to eject or retract buoyant cable antenna 9.

To ensure a difference in volume without making cylinder 12 excessively large, the following steps can be taken. (1) Eliminate as many air pockets as possible in housing 6. This can be achieved by filling voids with a syntactic foam which has high compressive strength but which is still light enough to be used where weight is of concern. (2) Fill housing 6 with a fluid so that any motion of piston 16 will immediately develop and increase the pressure in housing 6. Pressure will build up to the point where the pressure in housing 6 will overcome the forces of take-up spring assembly 25, all friction, and the external sea pressure on the end of buoyant cable antenna 9 external of tail section 3.

It should be noted that as the cable antenna 9 is ejected from the buoy, the take-up spring assembly 25 is rotated due to rotation of reel 7 as cable antenna 9 is ejected thereby winding up spring 25' of assembly 25.

The fourth condition assumes that the submarine is submerged, the buoy is at its reception depth and buoyant cable antenna 9 is fully ejected and floating on the water surface ready to receive the transmitted communications. Once the communication period has ended, the tethered buoy is reeled in by the submarine's winch and brought to rest on the cradle provided for the buoy.

While the buoy is in the process of being reeled in, sea pressure on piston 17 is gradually increasing, thereby moving piston 17 against spring 19 and at the same time moving piston 16 away from housing 6. This motion of piston 16 draws air from housing 6 making the pressure within housing 6 less than the sea pressure on the end of buoyant cable antenna 9. When this occurs, the extended buoyant cable antenna 9 is forced into pressure gland 11, through cable guide 8 and on to cable reel 7. The take-up spring assembly 25 prevents slack from developing in buoyant cable antenna 9 as it is being reeled onto cable reel 7. Drive rods 27 and 28 extending from spring drive pulley 26 engage cable reel 7 imparting a rotational motion to reel 7 due to the action of spring 25' of spring assembly 25 returning to an unwound condition. While reel 7 rotates it engages and travels on fixed righthand/lefthand lead screw 24 which produces a transverse motion for reel 7. The transverse and rotational motion of reel 7 causes buoyant cable antenna 9 to be reeled on reel 7 in successive layers.and turns, thereby maximizing the cable reel's holding capacity.

After the buoy has reached the submerged submarine and is secured to the buoy cradle, the submarine ascends toward the surface. During the ascension sea pressure on piston 17 gradually decreases allowing spring 19 to exert force on piston 17 and moves it toward port 20 and at the same time moves piston 16 in the direction of housing 6. This causes a higher air pressure in housing 6 than sea pressure on the end of buoyant cable antenna 9 external of the buoy. This condition normally forces or ejects buoyant cable antenna 9 from the tail section 3 of the buoy. To prevent ejection of buoyant cable antenna 9 while the buoy is nested in its cradle on the submarine any one or a combination of the following means may be employed.

(1) Build a mechanical stop on the cradle. (2) Provide a solenoid which locks buoyant cable antenna 9 in place when the buoy is in its cradle. The solenoid could be actuated by a permanent magnet located on the buoy cradle and a magnetically actuated switch located in the buoy. (3) Provide a pressure relief valve in line with drain port valve 21. The relief valve would be electrically actuated from within the submarine or mechanically at the buoy.

Slip ring 31 provides an arrangement for maintaining RF continuity between the buoyant cable antenna 9 and RF connector 32. The RF connector 32 provides the RF attachment point between cable reel 7 and the electro-mechanical tow cable 4. An air escape orifice 33 prevents piston 16 from being air locked when it moves toward air escape orifice 33. The air escape orifice 34 prevents piston 17 from being air locked when it moves to compress spring 19. "O" ring seal 35 provides the means for maintaining a seal between cable guide 8 and tail section 3, while O ring seals 36 form a dynamic seal between buoyant cable antenna 9 and pressure gland 11.

While I have described above the principles of my invention in connection with specific apparatus it is to be clearly understood that this description is made only by way of example and not as a limitation to the scope of my invention as set forth in the objects thereof and in the accompanying claims.

I claim:

1. A buoyant cable antenna reeling system for a buoy towed by a submerged submarine comprising:

a pressure sealed housing contained within said buoy;

a cable reel disposed for rotation within said housing;

a buoyant cable antenna disposed in an ejecting and retracting relationship with said reel, said cable antenna having one end thereof extending from said housing to the exterior of said buoy; and a cylinder-piston arrangement having a sea water inlet and a connection to said housing, said arrangement being responsive to the pressure of said sea water at said inlet to control air pressure in said housing to provide a pressure difference between said air pressure in said housing and the pressure of said sea water on said one end of said cable antenna exterior of said buoy for ejection and retraction of said cable antenna from and into said buoy.

2. A system according to claim 1, wherein said arrangement includes a cylinder having a longitudinal axis and a partition transverse of said axis to provide a first chamber coaxial of said axis adjacent said housing and a second chamber coaxial of said axis remote from said housing, a first piston disposed in said first chamber, a second piston disposed in said second chamber, a connecting member disposed coaxial of said axis and through said partition in a sealed relation therewith to connect said first and second pistons into an integrally movable unit, and a spring biasing said second piston toward said housing, said inlet being disposed between said partition and said second piston, and an outlet and said connection being disposed between said first piston and an end wall of said cylinder adjacent said housing.

3. A system according to claim 1, further including a cable guide extending between said housing and a sealed opening in said buoy wall through which said cable antenna is ejected and retracted.

4. A system according to claim 3, wherein said arrangement includes a cylinder having a longitudinal axis and a partition transverse of said axis to provide a first chamber coaxial of said axis adjacent said housing and a second chamber coaxial of said axis remote from said housing, a first piston disposed in said first chamber, a second piston disposed in said second chamber, a connecting member disposed coaxial of said axis and through said partition in a sealed relation therewith to connect said first and second pistons into an integrally movable unit, and a spring biasing said second piston toward said housing, said inlet being disposed between said partition and said second piston, and an outlet and said connection being disposed between said first piston and an end wall of said cylinder adjacent said housing.

5. A system according to claim 3, further including a take-up spring assembly disposed within said housing and coupled to said reel to prevent slack from developing in said cable antenna as it is being retracted and reeled onto said reel by providing rotary motion for said reel.

6. A system according to claim 5, wherein said arrangement includes a cylinder having a longitudinal axis and a partition transverse of said axis to provide a first chamber coaxial of said axis adjacent said housing and a second chamber coaxial of said axis remote from said housing, a first piston disposed in said first chamber, a second piston disposed in said second chamber, a connecting member disposed coaxial of said axis and through said partition in a selaed relation therewith to connect said first and second pistons into an integrally movable unit, and a spring biasing said second piston toward said housing, said inlet being disposed between said partition and said second piston, and an outlet and said connection being disposed between said first piston and an end wall of said cylinder adjacent said housing.

7. A system according to claim 5, further including a fixed righthand/lefthand lead screw disposed in said housing and engaged by said reel to impart a translating motion to said reel.

8. A system according to claim 7, wherein said arrangement includes a cylinder having a longitudinal axis and a partition transverse of said axis to provide a first chamber coaxial of said axis adjacent said housing and a second chamber coaxial of said axis remote from said housing, a first piston disposed in said first chamber, a second piston disposed in said second chamber, a connecting member disposed coaxial of said axis and through said partition in a sealed relation therewith to connect said first and second pistons into an integrally movable unit, and a spring biasing said second piston toward said housing, said inlet being disposed between said partition and said second piston, and an outlet and said connection being disposed between said first piston and an end wall of said cylinder adjacent said housing.

9. A system according to claim 1, further including a take-up spring assembly disposed within said housing and coupled to said reel to prevent slack from developing in said cable antenna as it is being retracted and reeled onto said reel by providing rotary motion for said reel.

10. A system according to claim 9, wherein said arrangement includes a cylinder having a longitudinal axis and a partition transverse of said axis to provide a first chamber coaxial of said axis adjacent said housing and a second chamber coaxial of said axis remote from said housing, a first piston disposed in said first chamber, a second piston disposed in said second chamber, a connecting member disposed coaxial of said axis and through said partition in a sealed relation therewith to connect said first and second pistons into an integrally movable unit, and a spring biasing said second piston toward said housing, said inlet being disposed between said partition and said second piston, and an outlet and said connection being disposed between said first piston and an end wall of said cylinder adjacent said housing.

11. A system according to claim 9, further including a fixed righthand/lefthand lead screw disposed in said housing and engaged by said reel to impart a translating motion to said reel.

12. A system according to claim 11, wherein said arrangement includes a cylinder having a longitudinal axis and a partition transverse of said axis to provide a first chamber coaxial of said axis adjacent said housing and a second chamber coaxial of said axis remote from said housing, a first piston disposed in said first chamber, a second piston disposed in said second chamber, a connecting member disposed coaxial of said axis and through said partition in a sealed relation therewith to connect said first and second pistons into an integrally movable unit, and a spring biasing said second piston toward said housing, said inlet being disposed between said partition and said second piston, and an outlet and said connection being disposed between said first piston and an end wall of said cylinder adjacent said housing.

13. A system according to claim 1, further including a fixed righthand/lefthand lead screw disposed in said housing and engaged by said reel to impart a translating motion to said reel.

14. A system according to claim 13, wherein said arrangement includes a cylinder having a longitudinal axis and a partition transverse of said axis to provide a first chamber coaxial of said axis adjacent said housing and a second chamber coaxial of said axis remote from said housing, a first piston disposed in said first chamber, a second piston disposed in said second chamber, a connecting member disposed coaxial of said axis and through said partition in a sealed relation therewith to connect said first and second pistons into an integrally movable unit, and a spring biasing said second piston toward said housing, said inlet being disposed between said partition and said second piston, and an outlet and said connection being disposed between said first piston and an end wall of said cylinder adjacent said housing.

* * * * *